US007674014B2

(12) United States Patent
Kirsten et al.

(10) Patent No.: US 7,674,014 B2
(45) Date of Patent: Mar. 9, 2010

(54) LIGHTING INSTALLATION

(75) Inventors: Martin Kirsten, Burscheid (DE); Bernhard Schutte, Langenfeld (DE); Matthias Koller, Leichlingen (DE); Thorstan Kretzer, Leverkusen (DE)

(73) Assignee: **BA*RO GmbH & Co. KG**, Leichlingen (DE)

( * ) Notice: Subject to any disclaimer, the term of this patent is extended or adjusted under 35 U.S.C. 154(b) by 409 days.

(21) Appl. No.: 11/896,631

(22) Filed: Sep. 4, 2007

(65) Prior Publication Data

US 2008/0074876 A1 Mar. 27, 2008

(30) Foreign Application Priority Data

Sep. 26, 2006 (EP) ..... 06020095

(51) Int. Cl.
*F21V 7/10* (2006.01)
*F21V 21/26* (2006.01)

(52) U.S. Cl. ..... 362/269; 362/285; 362/287; 362/296.05; 362/427; 362/247

(58) Field of Classification Search ..... 362/269, 362/285, 287, 296.05, 427, 247
See application file for complete search history.

(56) References Cited

U.S. PATENT DOCUMENTS 4,006,355 A * 2/1977 Shemitz et al. ..... 362/217.06
2008/0079343 A1* 4/2008 Kirsten et al. ..... 313/111

* cited by examiner

*Primary Examiner*—Stephen F Husar
*Assistant Examiner*—James W Cranson
(74) *Attorney, Agent, or Firm*—Berenato & White, LLC

(57) ABSTRACT

A lighting installation has two light fixtures which each have an illuminant in a horizontal burning position and a box reflector surrounding the illuminant. The box reflectors of the two light fixtures are each designed to produce half bat wing light distributions. The two light fixtures are positioned parallel to one another such that they together produce bat wing distribution and the two light fixtures can be adjusted in relation to one another.

8 Claims, 5 Drawing Sheets

LIGHTING INSTALLATION

CROSS-REFERENCE TO RELATED APPLICATIONS AND CLAIM TO PRIORITY

This application is related to application number 06 020 095.3, filed Sep. 26, 2006 in the European Patent Office, the disclosure of which is incorporated by reference and to which priority is claimed.

FIELD OF THE INVENTION

The present invention relates to a lighting installation with two light fixtures which each have an illuminant in a horizontal burning position and a box reflector surrounding the illuminant.

BACKGROUND OF THE INVENTION

Goods display surfaces such as for example refrigerated display cases, fruit displays and sales shelves etc. are generally lit artificially. The aim here is to light the elongated, rectangular surfaces of the sales units as evenly as possible. For this, one often uses light fixtures as are known from EP 1 225 300 B1. These light fixtures have a high pressure discharge lamp as an illuminant and a box reflector which produces bat wing light distribution at right angles to the longitudinal axis of the lamp. By using high pressure discharge lamps the concentrated production of high luminous fluxes is possible, and so a large volume of power in the smallest of spaces is provided. If these high luminous fluxes are distributed in the longitudinal direction of the surface to be lit by the optical system of the box reflector which produces bat wing light distribution in the longitudinal direction of the surface to be lit, with light fittings with small geometries relatively large lighting distances of 2 m and more can be achieved.

The known light fixtures have proved to be of value in practice. It is considered a disadvantage, however, that different light distributions are required dependently upon the respective ceiling height, the lighting requirements and the spatial circumstances. For this reason it has been necessary up until now to provide an individual light fixture adapted to the respective circumstances.

SUMMARY OF THE INVENTION

It is the object of the invention to specify a lighting installation of the type mentioned at the start which can be used universally for different ceiling heights, lighting requirements and spatial circumstances.

This object is fulfilled according to the invention in that the box reflectors of the two light fixtures are each designed to produce half bat wing light distribution, the two light fixtures being positioned lying parallel to one another such that they together produce bat wing light distribution and that the two light fixtures can be adjusted in relation to one another.

Therefore, the consideration which forms the basis of the invention is to produce bat wing light distribution by the interaction between two light fixtures which each produce half bat wing light distribution. These two light fixtures can be adjusted in relation to one another, by means of which it is possible to influence the light distribution produced.

According to one embodiment of the invention, provision is made, for example, such that the two light fixtures can be pivoted about parallel pivot axes in a pivot plane lying at right angles to the longitudinal axes of the illuminants. By at the same time pivoting the light fixtures towards or away from one another, the main angle of radiation of the symmetrical bat wing light distribution produced can be adjusted. By pivoting the two reflector systems unevenly, asymmetrical bat wing light distribution can be produced.

According to one embodiment of the invention, provision is made such that the light fixtures can be pivoted about pivot axes which extend through the reflectors. By means of this design it is made possible to adjust the inclination of the two light fixtures, and so of their box reflectors, in relation to one another, by means of which a concentrated, deep or half-width light intensity distribution can be produced.

Alternatively, or in addition, the light fixtures can be pivotably fitted by means of pivoted levers to an attachment provided a distance away from the box reflectors so that the light fixtures can be moved towards and away from one another. It is particularly preferred if the pivoted levers are held on the attachment and on the light fixtures such that they can pivot about parallel pivot axes so that the light fixtures can be pivoted on the one hand by means of the pivot axis extending through the attachment, and on the other hand can be tilted about the pivot axes extending through the reflectors. In this way the adjustment possibilities are afforded a high degree of flexibility so that the light fixtures are adjusted optimally to the respectively desired tasks and to the spatial circumstances that are available.

According to a further advantageous embodiment, provision is made such that the light fixtures are disposed on a common attachment. This attachment can be turned in a plane at right angles to the pivot axis of the light fixtures about a pivot axis extending in particular centrally through the attachment. This turning possibility opens up the possibility of turning the whole lighting installation so that when fitted to a ceiling it can also be used to light a wall, for example. If the attachment is turned about 180° and the light fixtures are then pivoted back by 180° in relation to the attachment by means of the pivoted levers, the two light fixtures produce deeply emitting light distribution, the precise path of which can be influenced by the adjustment possibilities which are provided.

In a way known in its own right the illuminants can be in the form of a high pressure discharge lamp, in particular of a metal halogen vapour lamp or of a sodium vapour lamp with improved colour reproduction. With these lamps high luminous fluxes can be produced.

BRIEF DESCRIPTION OF THE DRAWINGS

With regard to further advantageous embodiments of the invention, reference is made to the sub-claims and the following description of an example of an embodiment with reference to the attached drawings. The drawings show as follows:

DETAILED DESCRIPTION OF THE PREFERRED EMBODIMENT(S)

Figure 1:
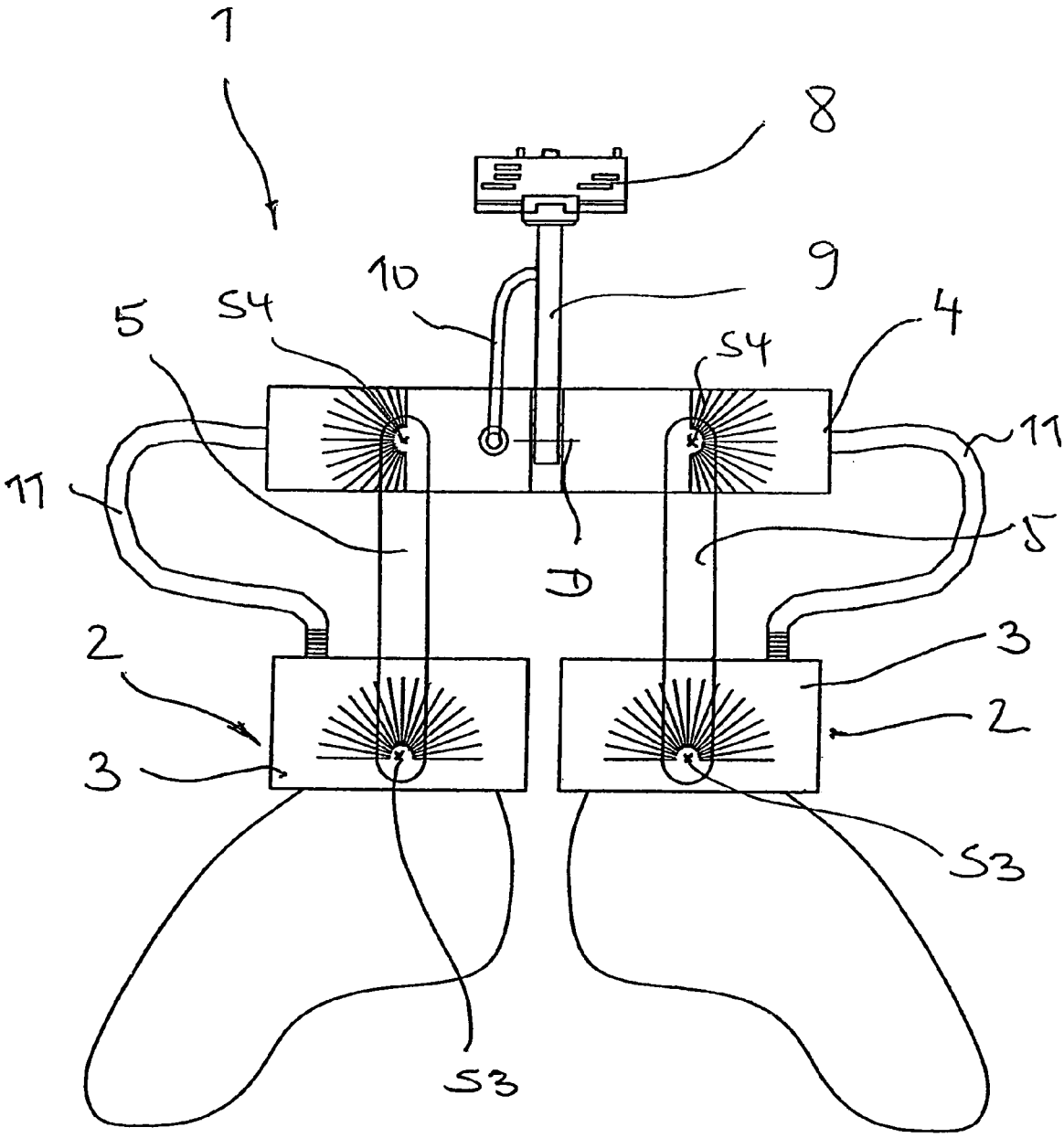
FIG. 1 is a schematic front view of a lighting installation according to the present invention.
Figure 2:
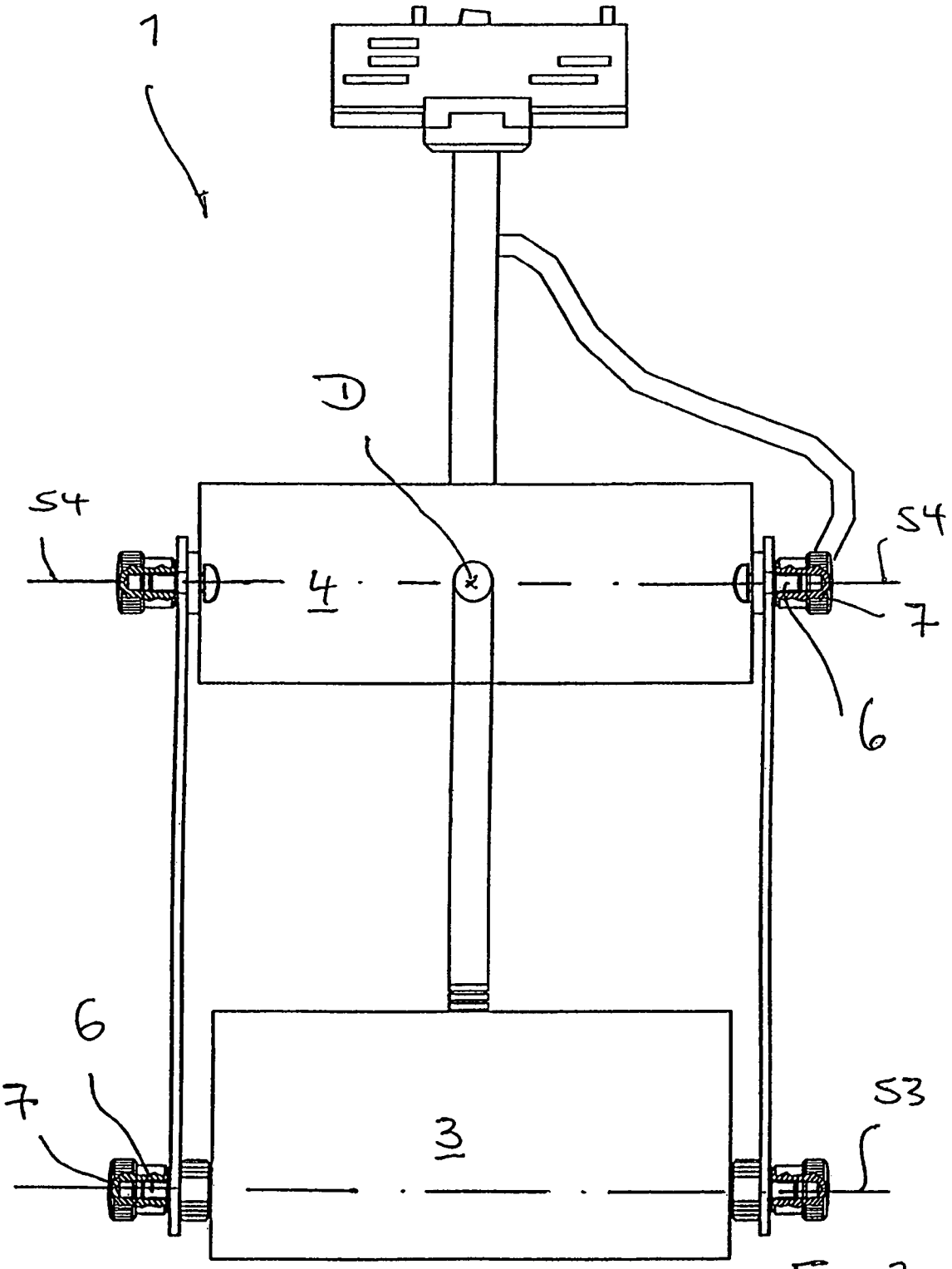
FIG. 2 is an enlarged side view of the lighting installation of FIG. 1.

FIGS. 1 and 2 schematically illustrate a lighting installation 1 according to the invention which can, for example, be fitted to a ceiling. The lighting installation 1 comprises two light fixtures 2 which each have a box reflector 3 and an illuminant in the form of a high pressure discharge lamp positioned therein in a horizontal burning position. These light fixtures 2 are positioned such that the longitudinal axes of the high pressure discharge lamps lie parallel to one another and extend at right angles to the plane of the page of FIG. 1. As can be seen in FIG. 1, the box reflectors 3 are designed so that they each produce half bat wing light distribution which in the superposed state result in a bat wing light distribution curve.

The light fixtures 2 are fitted to a common attachment 4 which is provided a distance away from and above the box reflectors 3. The box reflectors 3 are connected to the attachment 4 by pivoted levers 5 which are linked to the box reflectors 3 on the one hand and to the attachment 4 on the other hand about pivot axes S3, S4 extending parallel to the longitudinal axes of the high pressure discharge lamps so that the pivoted levers 5 and the box reflectors 3 can be pivoted about the pivot axes S3, S4 in the image plane of FIG. 1.

As can be seen well in FIG. 2, the jointed connections are formed by pivot bolts 6 onto which a knurled screw 7 is respectively screwed from the outside, and this is released in order to pivot the arrangement, and can be tightened again once the desired pivot position has been adopted in order to brace the pivoted lever 5 with the attachment 4 and the box reflector 3 and to thus secure the arrangement.

The lighting installation 1 further comprises an electrical supply unit 8 which can be fitted directly to a wall, ceiling or similar and is connected to the attachment 4 by means of a connection bar 9. As can be seen particularly well in FIG. 1, the attachment 4 is fitted to the connection bar 9 pivotably about a horizontal pivot axis D lying in the image plane of FIG. 1 so that the attachment 4 can be pivoted about the pivot axis D in a vertical plane which extends at right angles to the pivot plane of the light fixtures 2. The electrical supply unit 8 is connected to the attachment 4, in which the cut-in units for the high pressure discharge lamps are also accommodated, by means of an electrical supply cable 10, and the electrical cut-in units are connected to the box reflectors 3 by connection cables 11.

FIG. 1 shows the lighting installation 1 according to the invention in its initial position in which it produces bat wing light distribution by means of its two light fixtures 2. This standard light distribution can be changed by the box reflectors 3 being pivoted symmetrically away from or towards one another about the pivot axes S3, S4 by pivoting the pivoted levers 5 in relation to the attachment 4, and/or the box reflectors 3 and their pivot axes S3 being tilted in relation to the pivoted levers 5. In this way symmetrical bat wing light distribution can be produced with a desired main angle of radiation. By pivoting the two box reflectors 3 unevenly, it is possible to produce asymmetrical bat wing light distribution.

Figure 3:
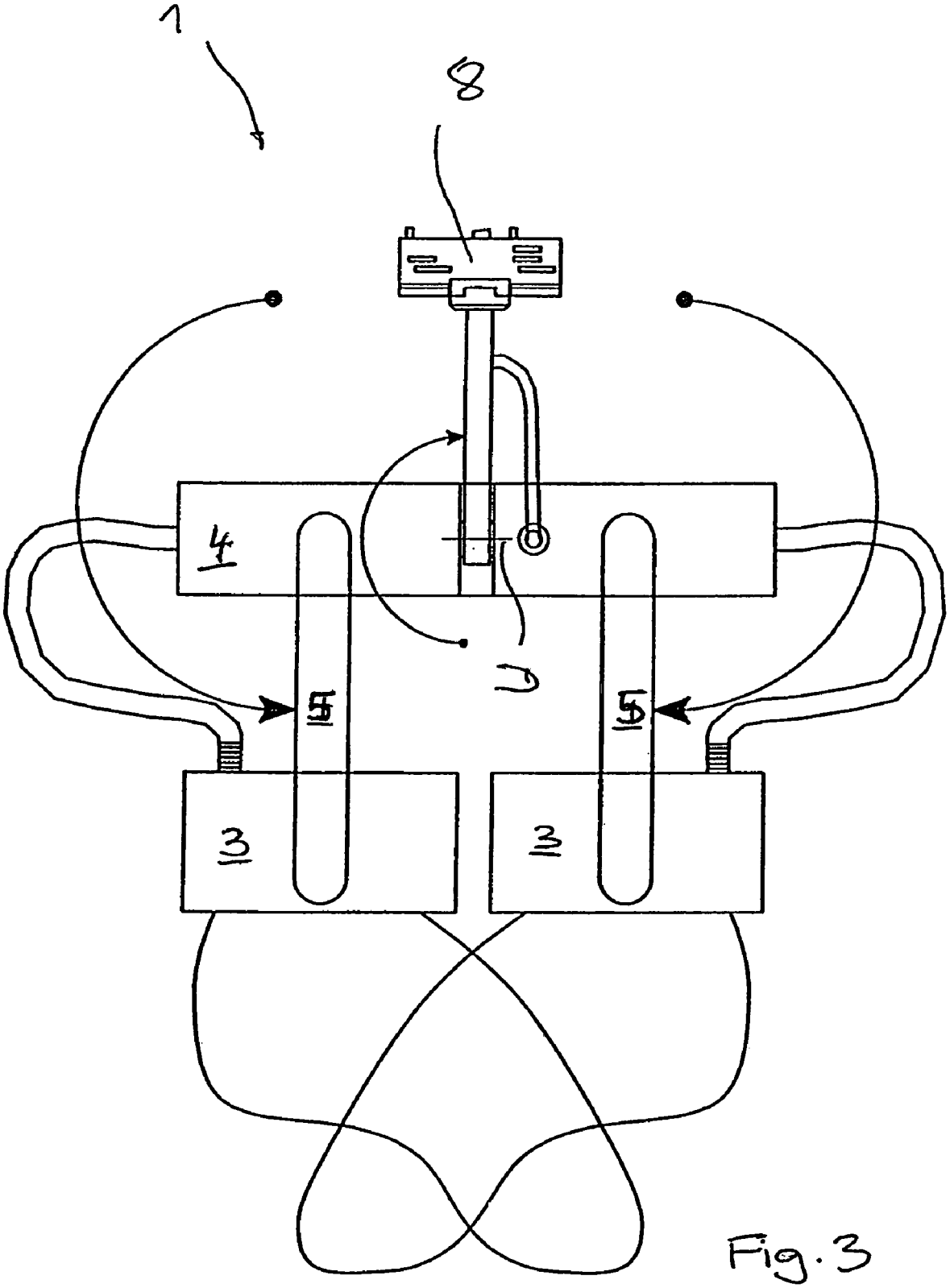
FIG. 3 illustrates the lighting installation of FIG. 1 in a pivoted position.
Figure 4:
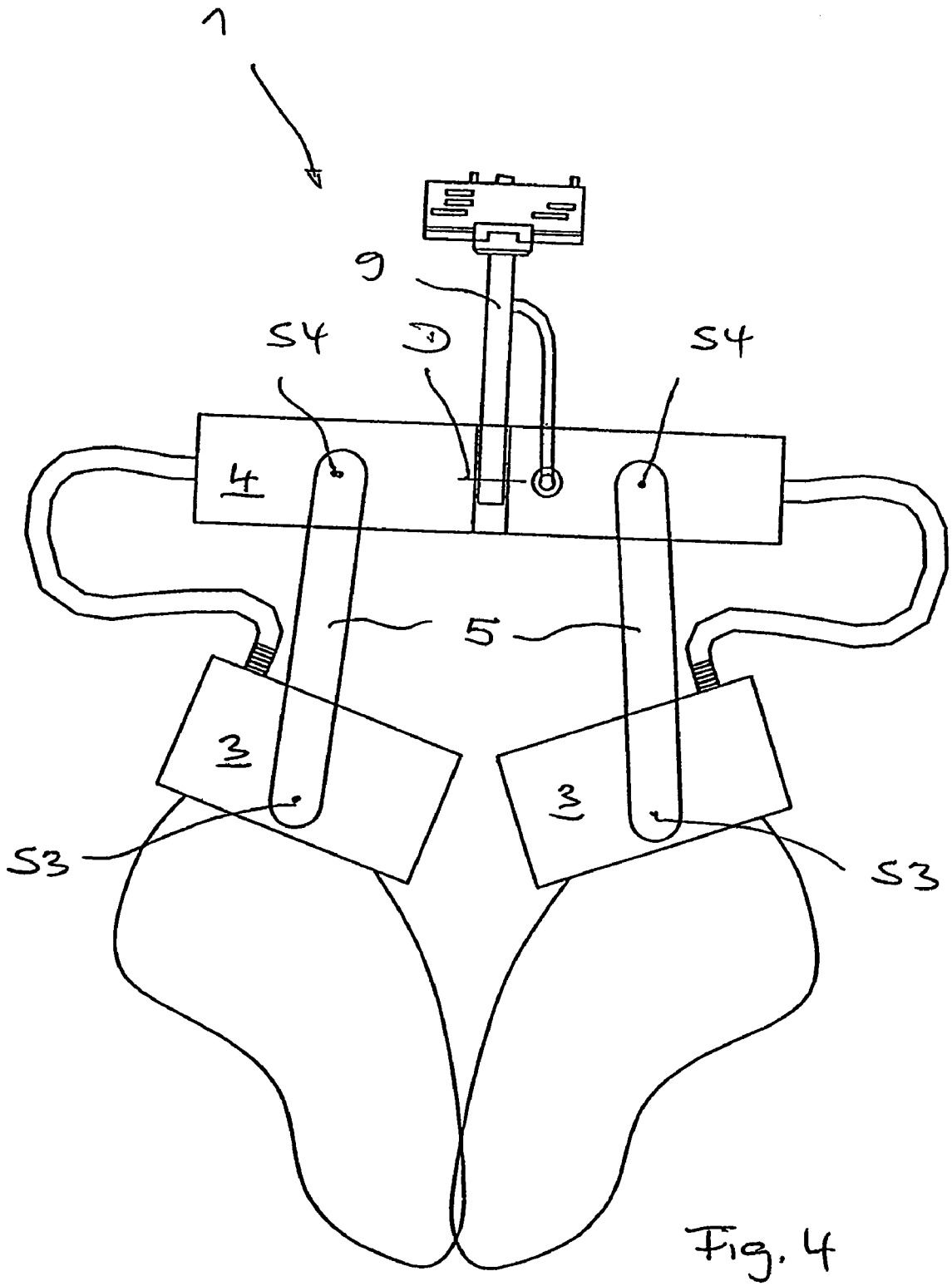
FIG. 4 illustrates the lighting installation of FIG. 3 with outwardly pivoted light fixtures.

FIG. 3 shows the lighting installation 1 after the attachment 4 has been turned by 180° about the pivot axis D out of the position shown in FIG. 1, and the pivoted levers 5 have been pivoted back downwards by 180° about the pivot axes S4 in relation to the attachment 4. In this case the two light fixtures 2 produce the light distribution curve of a deep emitter the path of which can be adjusted. As an example, FIG. 4 shows a setting with which the pivoted levers 5 are pivoted evenly and slightly outwards from the position shown in FIG. 3, and in addition the box reflectors 3 are tilted outwards in relation to the pivoted levers 5.

Figure 5:
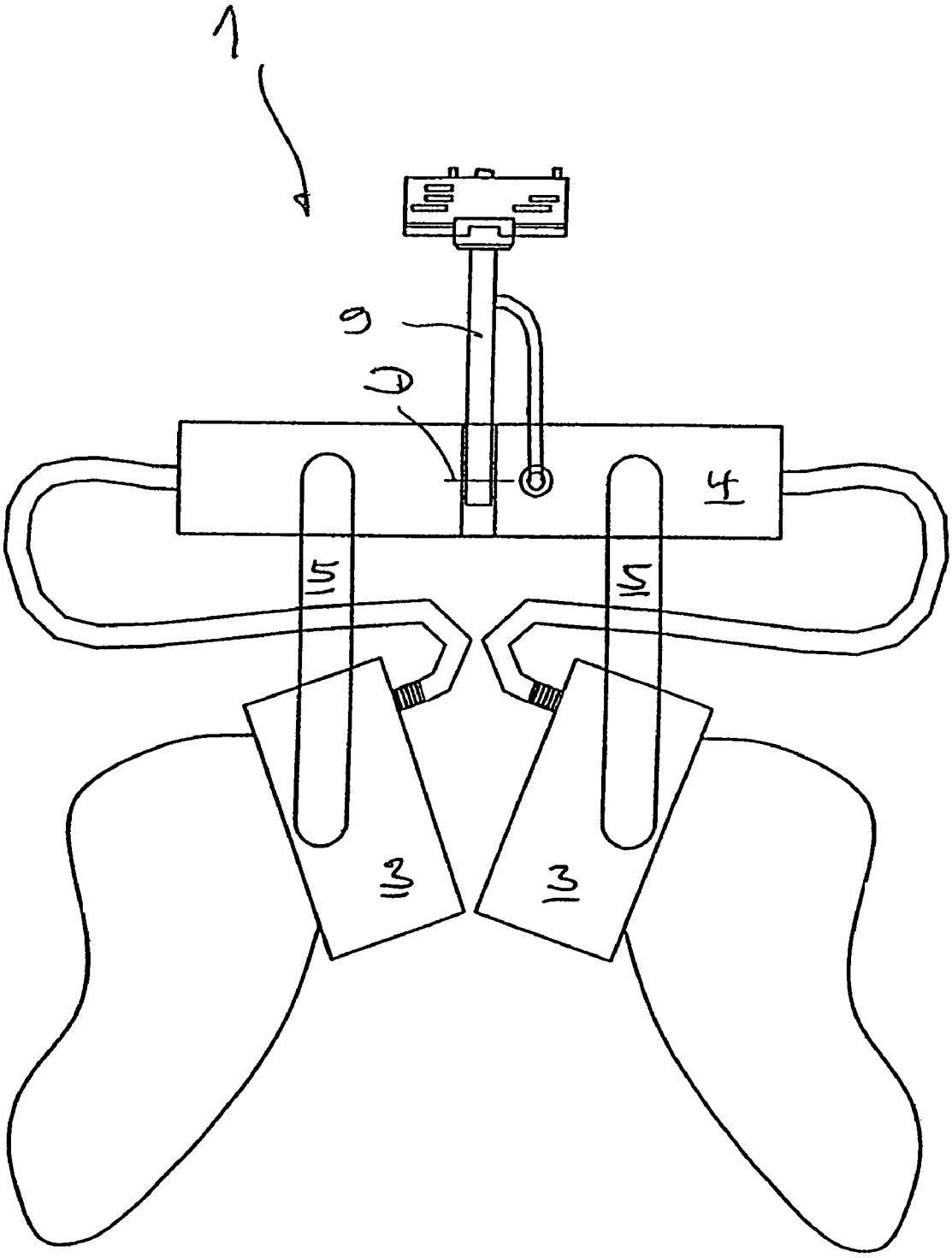
FIG. 5 illustrates the lighting installation of FIG. 3 with light fixtures pivoted further outwards.

FIG. 5 shows a further embodiment with which the pivoted levers 5 adopt the vertical position without any change, but the box reflectors 3 are tilted a long way outwards in relation to the pivoted levers 5. With this alignment it is possible with the lighting installation 1 according to the invention to light two opposite walls at the same time.

We claim:

1. A lighting installation with two light fixtures (2) which each have an illuminant in a horizontal burning position and a box reflector (3) surrounding the illuminant, characterised in that the box reflectors (3) of the two light fixtures (2) are each designed to produce half bat wing light distribution, the two light fixtures (2) being positioned lying parallel to one another such that they together produce bat wing distribution and that the two light fixtures (2) can be adjusted in relation to one another.

2. The lighting installation according to claim 1, characterised in that the two light fixtures (2) can be pivoted about parallel pivot axes (S3, S4) in a pivot plane lying at right angles to the longitudinal axes of the illuminants.

3. The lighting installation according to claim 2, characterised in that the light fixtures (2) can be pivoted about pivot axes (S3) which extend through the box reflectors (3).

4. The lighting installation according to claim 2, characterised in that the light fixtures (2) are pivotably held by means of pivoted levers (5) to an attachment provided a distance away from the box reflectors (3).

5. The lighting installation according to claim 4, characterised in that the pivoted levers (5) are held on the attachment (4) and on the light fixtures (2) such that they can pivot about parallel pivot axes (S4).

6. The lighting installation according to claim 4, characterised in that a common attachment (4) is allocated to the light fixtures (2).

7. The lighting installation according to claim 6, characterised in that the attachment (4) can be turned in a plane at right angles to the pivot plane of the light fixtures (2) about a pivot axis (9) extending in particular centrally through the attachment.

8. The lighting installation according to claim 1, characterised in that the illuminants are in the form of a high pressure discharge lamp, in particular of a metal halogen vapour lamp or of a sodium vapour lamp with improved colour reproduction.

* * * * *